United States Patent [19]

Holk

[11] Patent Number: 4,949,488

[45] Date of Patent: Aug. 21, 1990

[54] CASSETTE AND AN APPURTENANT APPARATUS HAVING A SCREEN FOR CYCLICAL DISPLAYING OF A PLURALITY OF PICTURES

[76] Inventor: Jon Holk, 23 Vennemindevej, DK-2100 Copenhagen 0, Denmark

[21] Appl. No.: 231,587

[22] Filed: Aug. 8, 1988

Related U.S. Application Data

[63] Continuation of Ser. No. 904,766, Sep. 5, 1986, abandoned, which is a continuation of Ser. No. 530,582, filed as PCT DK83/00004 on Jan. 13, 1983, published as WO83/02517 on Jul. 21, 1983, abandoned.

[30] Foreign Application Priority Data

Jan. 15, 1982 [DK] Denmark ..... 168/82

[51] Int. Cl.[5] ..... G09F 7/00

[52] U.S. Cl. ..... 40/488; 40/476; 40/491

[58] Field of Search ..... 40/471, 476, 488, 509, 40/511, 489, 490, 491

[56] References Cited

U.S. PATENT DOCUMENTS

| | | | |
|---|---|---|---|
| 383,361 | 5/1888 | Kilham | 40/488 |
| 395,623 | 1/1889 | Kilham | 40/488 |
| 718,305 | 1/1903 | Blanchard | 40/488 |
| 1,573,344 | 2/1926 | Jordan | 40/488 |
| 1,732,178 | 10/1929 | Beasley | 40/488 |
| 1,806,678 | 5/1931 | Farkas | 40/488 |
| 2,117,186 | 5/1938 | MacLaren | 40/488 |
| 2,117,187 | 5/1938 | MacLaren | 40/488 |
| 2,799,105 | 7/1957 | Tilley | 40/488 |
| 2,833,066 | 5/1958 | Morrissey | 40/488 |
| 3,080,668 | 3/1963 | Reali | 40/476 |
| 3,289,334 | 12/1966 | Forest | 40/486 |
| 3,430,371 | 3/1969 | Phillips | 40/486 |
| 3,430,372 | 3/1969 | Rutchick | 40/486 |
| 3,774,330 | 11/1973 | Devanney | 40/476 |
| 4,164,086 | 8/1979 | Morgan et al. | 40/476 |

*Primary Examiner*—James R. Brittain
*Assistant Examiner*—J. Hakomaki

[57] ABSTRACT

A display apparatus comprises a front stack of superimposed sheets which have cut lines and openings which form horizontally extending strips on the sheets. These strips are interleaved with similarly formed strips in a rear stack of sheets. In the interleaved position, upper portions of the front most sheets in the front and rear stacks are visible and are advantageously pictureless. To display a picture, one of the sheets in each of the front and rear stacks is lifted to expose their upper portions which carry segments of the same picture.

4 Claims, 4 Drawing Sheets

CASSETTE AND AN APPURTENANT APPARATUS HAVING A SCREEN FOR CYCLICAL DISPLAYING OF A PLURALITY OF PICTURES

This application is a continuation of application Ser. No. 06/904,766 filed Sept. 5, 1986 which in turn is a continuation application of Ser. No. 530,582 filed as PCT DK83/00004 on Jan. 13, 1983 published as WO83/02517 on Jul. 21, 1983, both abandoned.

FIELD AND BACKGROUND OF THE INVENTION

The invention relates to an apparatus having a screen for showing a plurality of pictures, each being composed of picture segments on at least two groups of horizontal strips, the strips in each individual group being made in one continuous sheet and being separated from one another by horizontal cutting lines extending between two marginal portions of the sheet. The various sheets are placed one upon the other, in such a manner that the strips carrying the picture segments are gathered in a number of piles which are equal to the number of strips in each sheet. The number of strips in each pile is equal to the number of picture forming groups, and each single sheet—with the group of strips formed therein—is displaceable in a plane relative to the other sheets, i.e. relative to the other strips in the piles, in such a manner that the picture segments on them become visible and together with picture segments on at least one more displaced group of strips in another sheet, form a continuous picture.

The word "cassette" as used herein meant to denote an easily replaceable unit comprising a plurality of groups of strips, where the strips in each group form a picture and the strips in the different groups overlap each other in a louverlike manner and are mutually displaceable by simultaneously moving all strips in one and the same group relative to all other groups. In this way edge portions of the strips in the group in question will become visible and together with edge portions of other displaced stirps form a complete picture.

In known cassettes of this type, each strip is suspended in straps which are moved up and down by guide means which displace picture carrying edge portions of the individual groups of strips into a visible position in order to display a number of pictures sequentially (see Danish Patent Application No. 369/70 or U.S. Pat. No. 3,613,277). This method of suspending and moving the picture carrying strips is rather complicated. It has the effect that the cassette becomes rather thick, and each individual picture must be composed of relatively narrow edge portions on three or more groups of strips. This is because each strip can only be displaced along a fraction of its height, since the strips of the different groups which together form a picture, must overlap each other like louvers, in a position of rest, as well as in a position of display.

Further, from U.S. Pat. No. 3,659,367 it is known to use two sheets, each of which is divided into a plurality of picture carrying strips by means of cutting lines which at their ends join a short cutting line situated perpendicularly to the first cutting line in the marginal portion of the sheet. By mutual displacement of the sheets two different pictures can be shown alternately, but it is not possible to produce a greater number of pictures, e.g. 5 or 6 pictures successively, with one single cassette.

SUMMARY OF THE INVENTION

It is the object of the invention to provide a relatively thin cassette of the kind mentioned above which is easy to produce and is easily replaceable and which is adapted to display a greater number of pictures than hitherto possible, said cassette having strips which by a simple guide means can be displaced safely over a substantial part of their height, preferably in such manner that only two groups of picture carrying strips are needed to form a whole picture.

Further, it is an object of the invention to provide an apparatus having simple guide means for safe control of the strip movements.

The cassette according to the invention is characteristic in that the cut lines between the strips in a picture forming group in a first sheet have marginal ends which join openings through the sheet that point away from the cutting line in the same vertical direction. Cut lines between the strips in a second picture forming group for use in obtaining the same picture also have ends which join openings pointing away from the cut line in a direction opposite to the direction of the first mentioned openings.

The simultaneously displaceable strips in each group are made by simply punching the cut lines and openings into a sheet, e.g. a sheet showing a complete picture, and the displacement of a group of strips is simply effectuated by displacement of the sheet by means of guide means engaging the marginal portions of the sheets. THe cassette that consists of flat sheets lying one upon the other, has a small thickness compared to the number of different pictures that can be shown, and because the openings in the sheets to be moved point in opposite directions, it has become possible to show for instance 6 different pictures successively.

Since the strips in two groups or two sheets can be mutually displaced over the entire strip height, a preferred embodiment of the invention is characteristic in that the strips in those groups that together form a complete picture are arranged in only two sheets, each of which carry a complete picture. Since each picture to be displayed requires only two identical picture sheets with the picture forming segments distributed on the two sheets and spaced from one another by a strip width, a reduced cassette thickness is obtained when compared with known cassettes containing three or more identical picture sheets for each picture to be displayed.

The openings at the ends of the cut lines may for instance be isosceles triangles which can be punched out by a simple tool.

If desired, the cassette according to the invention may simply comprise two sheets having oppositely pointing openings and each carrying its own picture, or possibly it may comprise a picture-less sheet and a single picture carrying sheet. Ordinarily, however, the sheets are made so as to show several, say five or six different pictures successively. According to the invention, this can be effectuated in that the sheets cooperating in pairs and carrying the same picture are arranged each within their own set of sheets, and that the openings in all the sheets in one set point in an opposite direction to the openings in all the sheets in the other set. By placing a preferably picture-less stationary front sheet in front of the sheets with the picture forming strips is obtained, and it has become possible to arrange an advantageous phase between the display of the individual pictures.

According to the invention, the sheets with the picture forming strips may in their marginal portions have means, e.g. securing holes or clamps so that they will be correctly arranged in vertically movable guide means in a display apparatus which, according to the invention, has corresponding gripping means to be coupled to the marginal portions of the picture forming sheets.

BRIEF DESCRIPTION OF THE DRAWINGS

The invention is explained in greater detail in the following with reference to the drawing where.

DESCRIPTION OF THE PREFERRED EMBODIMENT

Figure 1:
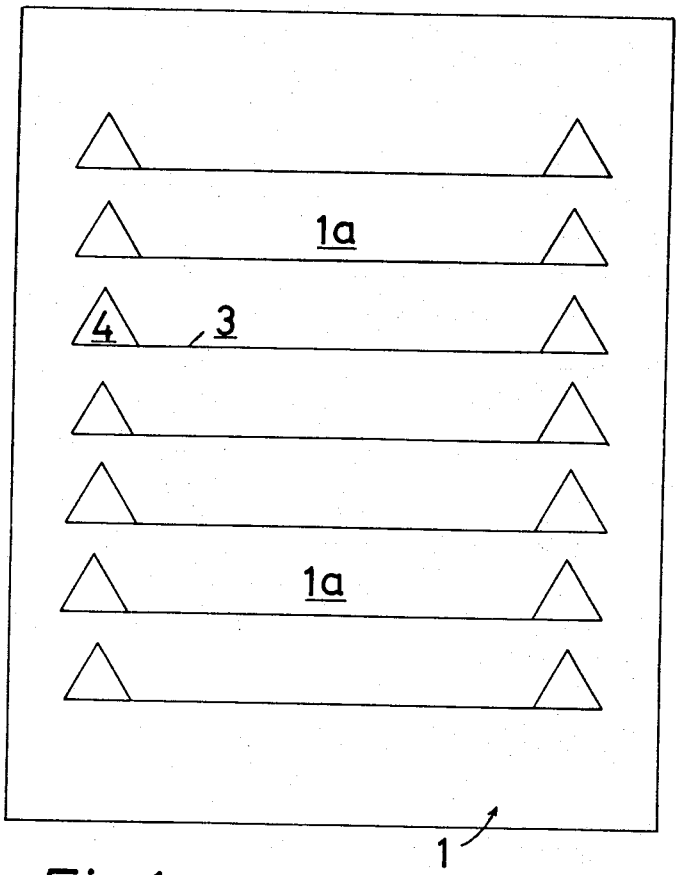
FIG. 1 is a plan view of a first front sheet in an embodiment of the invention.
Figure 8:
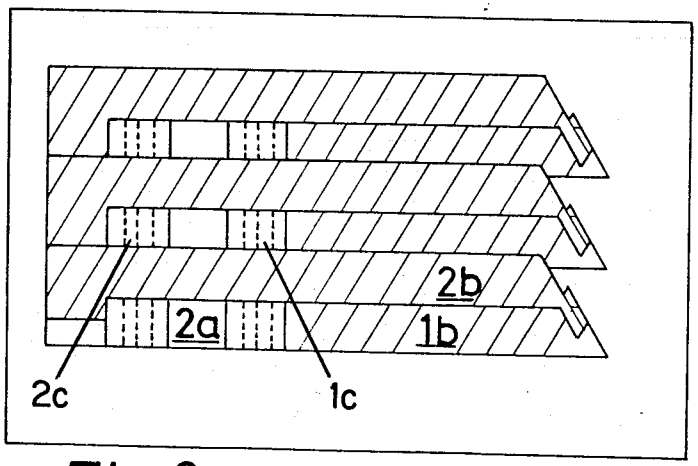
FIG. 8 is a view similar to FIG. 7 with an area cut away for illustrating the relative positions of the strips in the situation shwon in FIG. 7.

The illustrated embodiment of the invention, has a front sheet 1 which by a plurality of cut lines 3 has been divided into picture-less strips 1*a* forming a group of strips. At each end of the cut lines 3 an upwardly enlarged opening 4 has been punched out, forming an isosceles triangle with an apex extending upwardly from the cut line. As appears from FIGS. 6 and 8 a number of picture carrying sheets, (two sheets in the case shown) have been arranged behind the front sheet. These additional sheets have respective strips 1*b* and 1*c* which in their initial position are lying directly behind the strips 1*a* and thus are not visible in FIG. 1. These sheets are punched out in the same manner as the front sheet 1 in FIG. 1.

Figure 2:
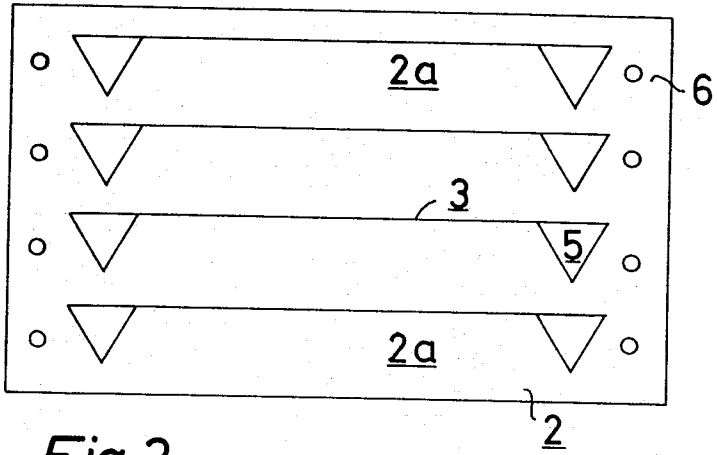
FIG. 2 is a partial plan view of a second front sheet of the invention.

Behind this first-mentioned stack or set of three sheets, a second set of sheets is located, the sheets having punched cut lines 3 and triangular openings 5 extending downwards from the corresponding cutting line 3 as shown in FIG. 2. Behind the front sheet 2 is a picture carrying sheet having strips 2*b* constituting a picture similar to the one formed by the strips 1*b* in the first picture carrying sheet of the first set of sheets. A rearmost sheet in the second set of sheets is a second picture carrying sheet with strips 2*c* carrying a picture which is identical with the picture formed by the strips 1*c* in the rearmost sheet of the first set of sheets.

Figure 3:
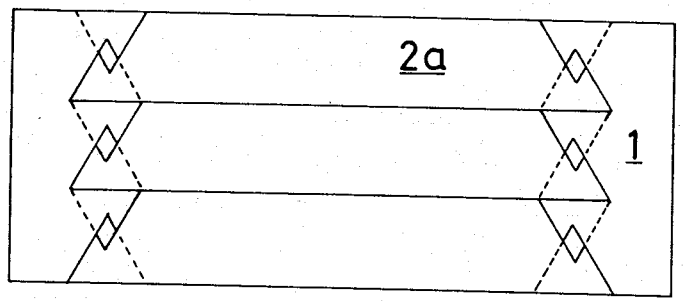
FIG. 3 is a plan view of the two front sheets shown in their relative positions in a display apparatus.
Figure 4:
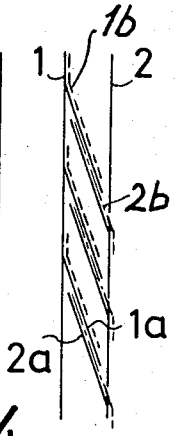
FIG. 4 is a vertical sectional view of FIG. 3.

The sets of sheets are placed in a display apparatus (not shown) having holding and guiding means engaging the marginal portions of the sheets and holding the front sheets 1 and 2 aligned in their positions shown in FIGS. 3 and 4, while the strips 1*b* and 1*c*, which are not visible in FIG. 3, extend behind the strips 1*a* to the right thereof. FIG. 4 shows one of the additional sheets with strips 1*b*, to the right of sheet 1. Strips 2*b* and 2*c* extend behind strips 2*a*, with the strips 2*b* lying between the strips 1*a* and 2*a* in FIG. 4. The holding and guiding means (not shown) can move the picture carrying sheets with the strips 1*b*, 1*c*, 2*b*, 2*c* individually in the vertical direction. The guiding means are actuated by a motor and programmed to move in such a manner that after a picture-less screen formed by the strips 1*a* and 2*a*, a picture constituted by the strips 1*b* and 2*b* follows and then a picture constituted by the strips 1*c* and 2*c*, possibly with the picture-less screen reappearing between each picture. For the sake of simplicity it is here shown and described only how two pictures are formed. It will be understood that several pictures, e.g. six pictures, can be successively displayed, in which case a corresponding number of picture carrying sheets with piles of strips lying one upon the other are provided. If desired, a cassette can also comprise more than two picture carrying sheets having cooperating identical pictures, each of which is divided in a group of strips. However, it is an essential advantage of the cassette according to the invention, that more than two identical picture carrying sheets for each picture to be displayed, are not required. The guiding means in the displaying apparatus are advantageously provided with pin-like members adapted to engage corresponding apertures 6 (FIG. 2) in the marginal portions of the sheets in order to ensure correct locating of the sheets in the apparatus. The marginal portions of the sheets could also be provided with clips or projecting lugs cooperating with gripping members on the guiding means.

Figure 5:
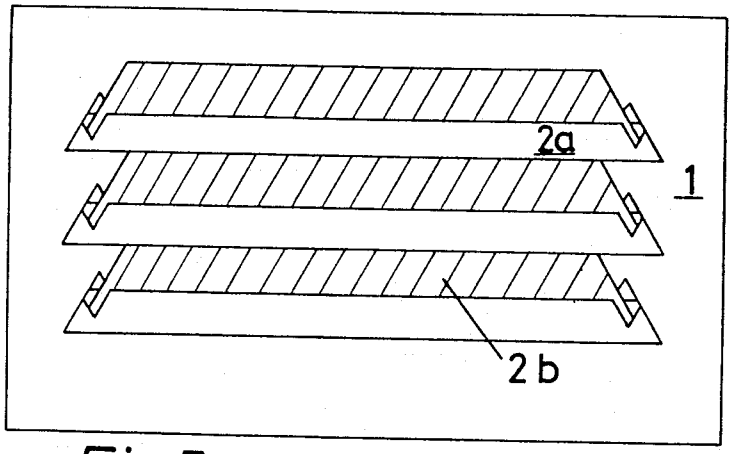
FIG. 5 is a front view of a part of the invention in which the rearmost of two cooperating picture sheets had been displaced upwardly so that a display zone on each strip has become visible.
Figure 6:
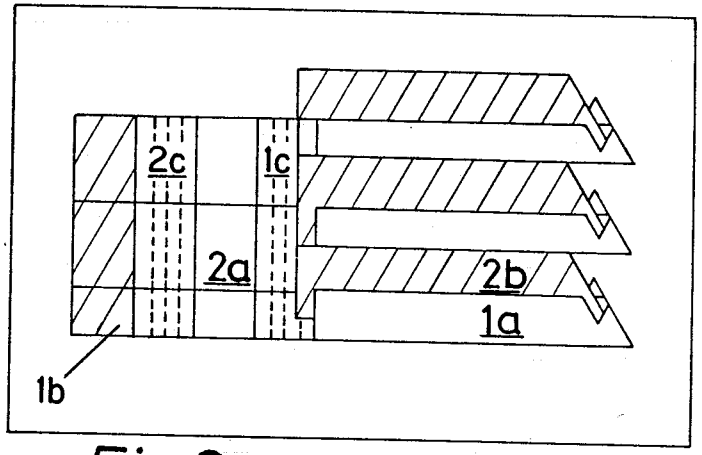
FIG. 6 is a view similar to FIG. 5 with an area cut away for illustrrating the positions of the individual strips in the apparatus in the condition shown in FIG. 5.
Figure 7:
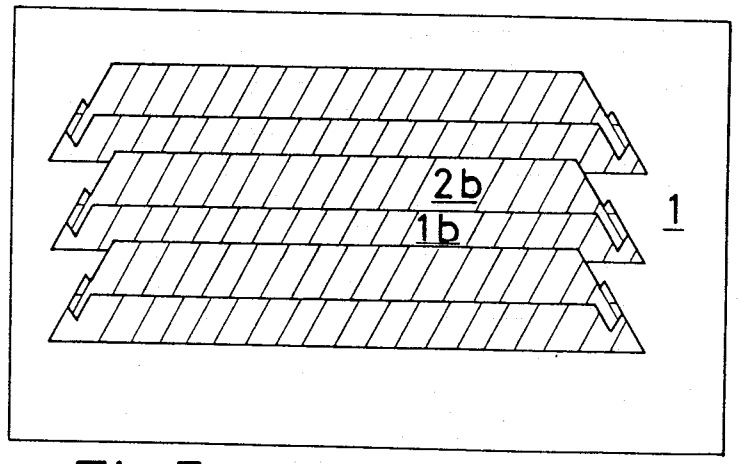
FIG. 7 is a plan view in which the foremost picture sheet cooperating with the picture sheet in FIG. 5 has been moved upwards in such manner that the display zones of the strips have become visible and complete the display zones on the picture sheet shown in FIG. 5.

When a picture corresponding to the one constituted by the strips 1*b* and the strips 2*b* respectively, is to be displayed, the sheets are moving in the following manner:

By an upward pull on the first picture carrying sheet in the second stack or set of sheets, the strips 2*b* are moved up beyond the upper edges of the strip 1*a* in the first front sheet, so that visible display zones with picture portions appear as shown in FIGS. 5 and 6. Simultaneously or immediately after or before, the first picture carrying sheet in the first set of sheets is pulled upwards in such manner that visible picture segments on the strip 1*b* will fill in the space between the visible picture portions of the strips 2*b*, whereby the complete picture will become visible, see FIGS. 7 and 8. The upper half of the strips 2*b* and the upper half of the strips 1*b* become visible, or in other words, the pictue on the picture carrying sheet of the first set (behind the first front sheet 1) must be displaced by half the height of a strip which is downwards relative to the picture on the picture carrying sheet with the strips 2*b* in the second set of sheets (behind the second front sheet).

It will be obvious that the openings 4, 5, which behind the first set of sheets extend upwards from the cut lines 3 and in the second set of sheets extend downwards from the cut lines 3, may have other shapes than that shown, of an isosceles triangle. Further, it will be obvious that the openings in the front stack of sheets might point downwards from the cutting lines and in the rear stack set of sheets might point upwards from the cutting lines, whereby the strips in the rear set of sheets will extend downwardly, and the displacement of the picture carrying sheets will be carried out in a downward direction. However, when a picture is illuminated by light from above, which most frequently will be the case, it is preferable that the cassette is constructed as shown in the drawing, because shadows from the free horizontal edges of the strips hereby may be avoided.

Futher, if desired the sheets may be placed in an arbitrary oblique position or lying horizontally or with both sides edges horizontally, but in the same vertical or slanting plane and with the vertical or slanting strips being illuminated from one side.

Figure 9:
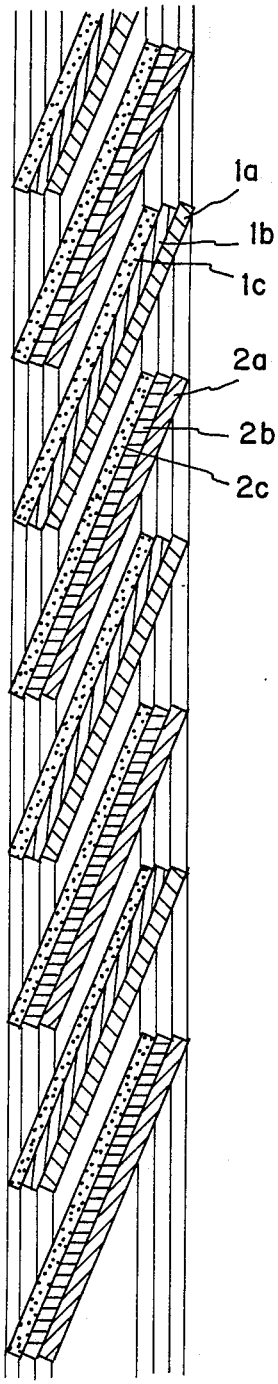
FIG. 9 is a sectional view of the invention, showing the strips of a first stack of sheets, interleaved with the strips from a second stack of sheets, in order to form a display having a picture of display area visible from the right in FIG. 9.
Figure 10:
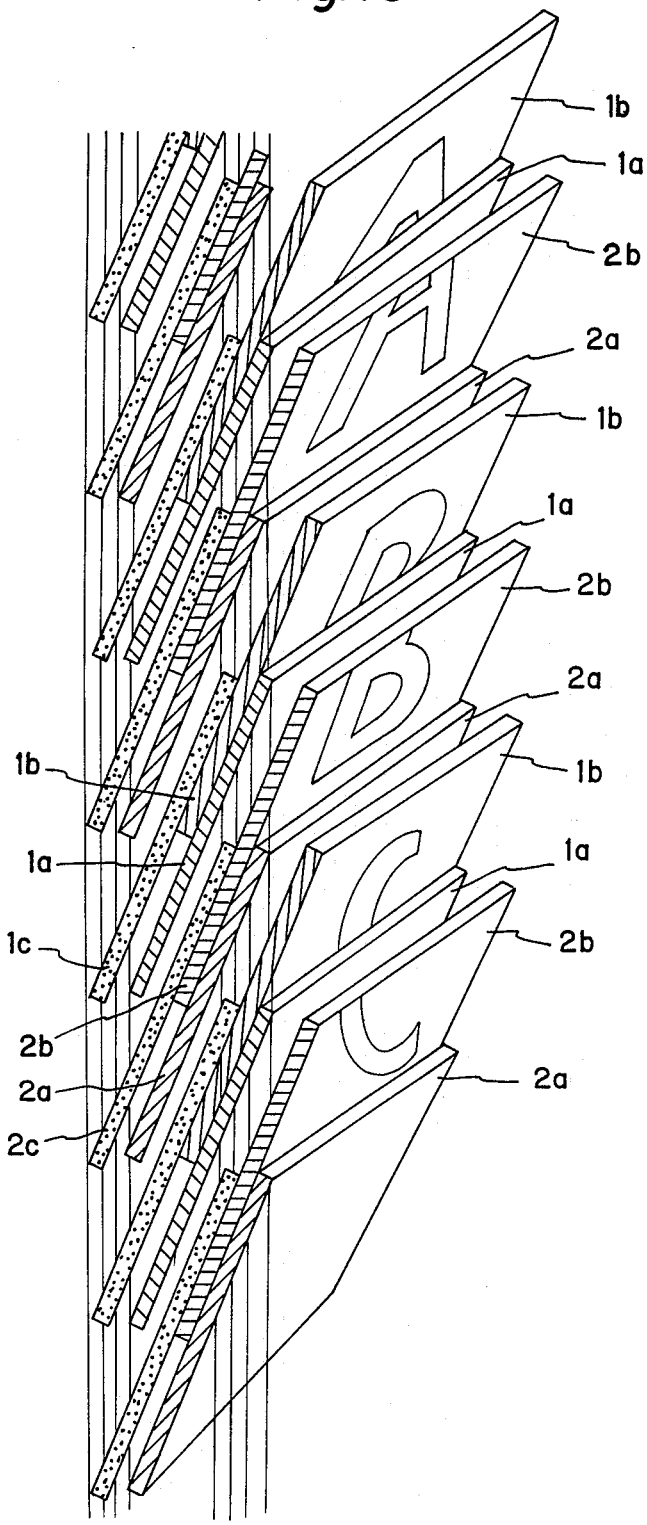
FIG. 10 is a view similar to FIG. 9 but in perspective where the second picture carrying sheet in each of the two stacks of sheets has been displaced upwardly by half the width of a strip, in order to display a complete picture, when viewed from the right in FIG. 10.

For additional explanation on how the invention operates, reference is now made to FIGS. 9 and 10. In FIG. 9, strips 1*a*, 1*b* and 1*c* of the front stack of sheets are shown interleaved and half covered by the strips 2*a*, 2*b* and 2*c* of the rear stack of strips. With the sheets in each stack, flush with each other, and if viewing the display of FIG. 9 from the right, the picture-less strips 1*a* and 2*a* are visible so that no picture is displayed. By lifting the second sheet in each stack, by half the vertical height of the strips, the upper halves of strips 1*b* and 2*b* become visibel. These strips cover the respective strips 2*a* and 1*a*. The upper halves of strips 1*b* and 2*b* produce a complete picture when viewing FIG. 10 from the right.

Figure 11:
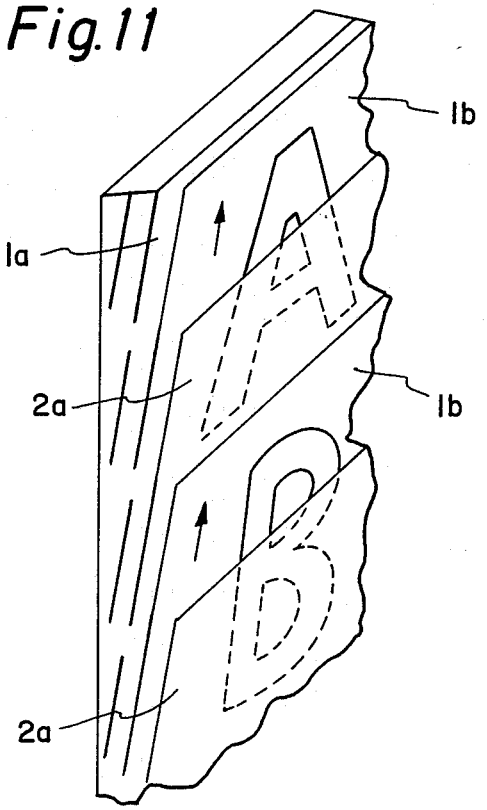
FIG. 11 is a partial schematic representation of the sheets showing the display which results from the movement of the second sheet in the first stack of sheets.
Figure 12:
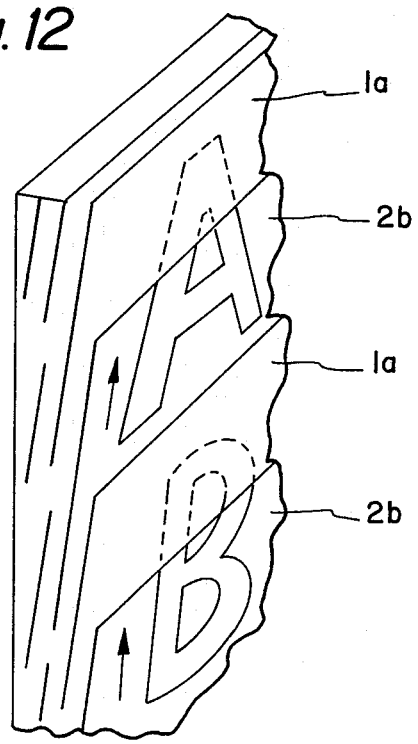
FIG. 12 is a view similar to FIG. 11 showin the display which results when the second sheet of the second stack of sheets is moved.

To further explain how the sheets from the first and second stacks of sheets interact with each other to form a display, FIG. 11 shows the display which would result if the second sheet 1*b* of the first stack of sheets is moved. In this position only the upper half of the image would be visible. FIG. 12 shows the situation where the second sheet of 2*b* of the second stack is moved, displaying the lower half of the image only. It is clear from FIGS. 11 and 12 that when both second sheets 1*b* and 2*b* of both the first and second stacks of sheets are moved, a complete image will be displayed.

For this application, terms such as horizontal, upwardly, downwardly and the like are used only as relative terms to describe relative directions and relationships between the various strips in the front and rear stacks of sheets. The display of the invention is equally useful if utilized upside down or on end, with the horizontal directions being transferred into vertical directions.

It will be understood that by the invention a flat cassette has been provided, in which the sheets can be moved so as to cylically display a plurality of pictures as the sheets are driven upwardly and downwardly in reciprocating movements by guiding means engaging the marginal portions of the sheets.

I claim:

1. A display apparatus for displaying a plurality of pictures, comprising:

a front stack of at least three superimposed front sheets, each front sheet having opposite marginal portions, a plurality of vertically spaced horizontal cut lines extending between the marginal portions, and an upwardly enlarged opening at opposite ends of each cut line, said cut lines and openings dividing each front sheet into a plurality of vertically spaced front strips, the front strips being superimposed in the front stack of sheets in a first position of the display apparatus;

a rear stack of at least three superimposed rear sheets, each rear sheet having opposite marginal portions, a plurality of vertically spaced horizontally cut lines extending between the marginal portions, and a downwardly enlarged opening at opposite ends of each cut line, said cut lines and openings dividing each rear sheet into a plurality of vertically spaced rear strips, the rear strips being superimposed in the rear stack of sheets in the first position of the display apparatus;

said superimposed front strips being interleaved with said superimposed rear strips in the first position of the display apparatus so that lower horizontal portions of said front strips are covered by upper horizontal portions of said rear strips for displaying an upper horizontal portion of the front strips in an uppermost sheet of said front stack, and the upper horizontal portions of the rear strips in an uppermost sheet of said rear stack, in said first position of the display apparatus; and each front sheet carrying at least segments of a different picture and each rear sheet carrying at least segments of a different picture, with segments of the same picture being carried by one sheet from each of said front and rear stacks, a sheet fron each of said front and rear stacks which carry at least segments of the same picture and which are below said uppermost front and rear sheets, being moved upwardly to establish a second position of the display apparatus which displays the same picture, the front and rear sheets being moved upwardly by an amount so that upper horizontal portions of the strips of the moved front sheet cover the upper horizontal portions of the rear strips of the uppermost rear sheet and upper horizontal portions of the rear strips of the moved rear sheet cover the upper horizontal portions of the front strips of the uppermost front sheet.

2. A display apparatus according to claim 1 wherein the uppermost rear sheet and the uppermost front sheet are both pictureless.

3. A display apparatus according to claim 1 wherein the picture segments on each of the front and rear sheets form a complete picture on each of the front and rear sheets with the same picture being carried by one of the front sheets and by one of the rear sheets.

4. A display apparatus according to claim 1 wherein each of the horizontal front and rear strips have the same vertical height, the displayed upper horizontal portions of the uppermost front and rear strips comprising approximately one-half of each strip.

* * * * *